US009810019B2

(12) United States Patent
Barnes et al.

(10) Patent No.: US 9,810,019 B2
(45) Date of Patent: Nov. 7, 2017

(54) ROLLER TUBE

(71) Applicant: Louver-Lite Limited, Cheshire (GB)

(72) Inventors: Antony Barnes, Stockport (GB); Andrew Greening, Sandbach Cheshire (GB)

(73) Assignee: Louver-Lite Limited, Cheshire (GB)

( * ) Notice: Subject to any disclaimer, the term of this patent is extended or adjusted under 35 U.S.C. 154(b) by 0 days.

(21) Appl. No.: 15/066,694

(22) Filed: Mar. 10, 2016

(65) Prior Publication Data

US 2016/0208550 A1 Jul. 21, 2016

Related U.S. Application Data

(63) Continuation of application No. 14/380,816, filed as application No. PCT/GB2013/050467 on Feb. 25, 2013, now abandoned.

(30) Foreign Application Priority Data

Feb. 23, 2012 (GB) ..... 1203153.0

(51) Int. Cl.

| | |
|---|---|
| ***E06B 9/56*** | (2006.01) |
| ***E06B 9/44*** | (2006.01) |
| ***E06B 9/72*** | (2006.01) |
| ***E06B 9/68*** | (2006.01) |
| ***E06B 9/17*** | (2006.01) |
| ***E06B 9/174*** | (2006.01) |
| ***E06B 9/50*** | (2006.01) |

(52) U.S. Cl.

CPC ..... *E06B 9/44* (2013.01); *E06B 9/174* (2013.01); *E06B 9/17076* (2013.01); *E06B 9/50* (2013.01); *E06B 9/68* (2013.01); *E06B 9/72* (2013.01)

(58) Field of Classification Search

CPC ..... E06B 9/44; E06B 9/17076; E06B 2009/17084; E06B 9/171; E06B 9/174; E06B 9/50; E06B 9/72

USPC ..... 160/310, 325, 323.1

See application file for complete search history.

(56) References Cited

U.S. PATENT DOCUMENTS 726,801 A 4/1903 Maxwell
745,570 A 12/1903 Clarke
(Continued)

FOREIGN PATENT DOCUMENTS

DE 102014017193 A1 * 5/2016 ..... E06B 9/171
DE EP 3059375 A1 * 8/2016 ..... E06B 9/171
(Continued)

OTHER PUBLICATIONS

Doyennette, Jul. 21, 2010, English Translation of "EP 2208849" provided by translationportal.epo.org.*
(Continued)

*Primary Examiner* — Katherine Mitchell
*Assistant Examiner* — Johnnie A Shablack
(74) *Attorney, Agent, or Firm* — Haugen Law Firm PLLP

(57) ABSTRACT

A roller tube comprising a tube body which defines on its outwardly facing surface one or more blind substrate or shutter substrate receiving portions, wherein the tube body includes a plurality of sound damping elements located circumferentially around its inwardly facing surface, the sound damping elements extending longitudinally along at least part of the length of the tube body and defining a plurality of sound channels inside the tube.

8 Claims, 9 Drawing Sheets

(56) References Cited

U.S. PATENT DOCUMENTS 1,780,727 A 11/1930 Tenney
2,159,235 A 5/1939 Tyler et al.
2,516,020 A 7/1950 Reed
2,571,382 A 10/1951 Raven
2,578,809 A 12/1951 Ketchum
3,195,618 A * 7/1965 Anderson ..... E06B 9/44 160/323.1
3,315,728 A 4/1967 Anderson et al.
3,340,922 A 9/1967 Anderson
3,515,417 A 6/1970 Bowman
3,521,694 A 7/1970 Anderson
3,854,517 A * 12/1974 Nakamura ..... E06B 9/50 160/321
4,159,162 A * 6/1979 Christoffel ..... G03B 21/58 160/24
4,508,126 A 4/1985 Everard
4,519,434 A 5/1985 Forquer
4,633,927 A * 1/1987 Labelle ..... E06B 9/171 160/133
4,636,106 A 1/1987 Waisbrod
4,790,683 A 12/1988 Cramer et al.
5,375,643 A 12/1994 Rude
5,507,374 A 4/1996 Rude
5,887,637 A 3/1999 Phyper
5,934,354 A * 8/1999 Price ..... B60R 5/047 160/313
6,782,938 B2 * 8/2004 Colson ..... E06B 9/32 160/121.1
6,843,301 B2 * 1/2005 Carrillo ..... E04F 10/0614 160/310
6,935,401 B2 8/2005 Fraczek et al.
6,955,023 B2 10/2005 Rotheroe
7,461,683 B2 * 12/2008 Wang ..... E06B 9/44 160/291
7,621,313 B2 11/2009 Pham
7,625,151 B2 * 12/2009 Li ..... E06B 9/174 160/324
7,740,047 B2 6/2010 Koop et al.
7,836,937 B2 11/2010 Anderson et al.
7,891,399 B2 * 2/2011 Rasmussen ..... E06B 9/42 160/120
8,004,224 B2 * 8/2011 Marchetto ..... E06B 9/88 160/311
8,006,737 B2 * 8/2011 Popa ..... E04F 10/06 160/263
8,282,285 B2 10/2012 Brillon
8,307,878 B2 11/2012 Faller et al.
8,371,358 B1 2/2013 Mullet
8,403,020 B2 * 3/2013 Rasmussen ..... E06B 9/42 160/120
8,418,742 B2 * 4/2013 Anderson ..... E06B 9/34 160/308
8,464,776 B2 6/2013 Anthoine
8,513,845 B2 * 8/2013 Angelini ..... E06B 9/72 160/310
8,608,126 B2 12/2013 Ng et al.
8,651,166 B1 2/2014 Daniels
8,662,139 B2 * 3/2014 Anthony ..... E06B 9/34 160/121.1
8,684,062 B2 4/2014 Ng
8,723,454 B2 * 5/2014 Skinner ..... E06B 9/322 318/16
8,776,861 B2 7/2014 Bohlen et al.
8,899,300 B2 12/2014 Daniels
9,206,640 B1 * 12/2015 Jennings ..... E06B 9/56
9,410,371 B2 * 8/2016 Faller ..... E06B 9/322
9,523,236 B2 * 12/2016 Bergamaschi ..... E06B 9/42
9,567,802 B2 * 2/2017 Buccola, Jr. ..... E06B 9/322
2001/0001414 A1 * 5/2001 Colson ..... E06B 9/32 160/178.1 R
2006/0086874 A1 * 4/2006 Habel ..... E06B 9/174 248/268
2008/0067278 A1 * 3/2008 Fortunato ..... E06B 9/42 242/407
2008/0073039 A1 3/2008 Gyngell et al.
2008/0110582 A1 * 5/2008 Rasmussen ..... E06B 9/44 160/263
2008/0121353 A1 * 5/2008 Detmer ..... E06B 9/72 160/266
2008/0230192 A1 * 9/2008 Kane ..... E06B 9/40 160/311
2009/0242145 A1 10/2009 Sheu
2010/0018656 A1 * 1/2010 Fujita ..... E06B 9/34 160/319
2010/0307701 A1 12/2010 Peterson
2011/0265958 A1 11/2011 Skinner et al.
2012/0267465 A1 * 10/2012 Kitani ..... B60J 7/0015 242/376
2013/0199735 A1 * 8/2013 Colson ..... E06B 9/42 160/2
2013/0213585 A1 * 8/2013 Nenonen ..... E06B 9/42 160/23.1
2013/0220556 A1 8/2013 Kroner
2013/0306255 A1 * 11/2013 Ng ..... E06B 9/44 160/368.1
2014/0216666 A1 8/2014 Smith et al.
2014/0251558 A1 * 9/2014 Chou ..... E06B 9/42 160/323.1
2014/0262081 A1 * 9/2014 Seib ..... E06B 9/44 160/325
2014/0262084 A1 9/2014 Fleischman
2014/0360686 A1 12/2014 Lin
2015/0000849 A1 1/2015 Barnes et al.
2015/0034260 A1 * 2/2015 Blair ..... E06B 9/42 160/310
2015/0136338 A1 * 5/2015 Lemaitre ..... E06B 9/72 160/310
2015/0300088 A1 * 10/2015 Lemaitre ..... E06B 9/42 242/390
2015/0361717 A1 * 12/2015 van 't Zelfde ..... E06B 9/40 160/309
2015/0368966 A1 * 12/2015 Faller ..... E06B 9/58 160/311
2016/0010390 A1 * 1/2016 Smith ..... E06B 9/60 160/302
2016/0032646 A1 * 2/2016 Fleischman ..... E06B 9/40 160/309
2016/0208550 A1 * 7/2016 Barnes ..... E06B 9/44
2016/0258211 A1 * 9/2016 Smith ..... E06B 9/38
2016/0326801 A1 * 11/2016 Blair ..... E06B 9/171
2016/0340977 A1 * 11/2016 Faller ..... E06B 9/322

FOREIGN PATENT DOCUMENTS

DE EP 2784263 B1 * 9/2016 ..... E06B 9/42
EP 2208849 7/2010
FR EP 1980704 B1 * 7/2015 ..... E06B 9/171
GB WO 2010139945 A1 * 12/2010 ..... E06B 9/50
WO 2010139945 12/2010

OTHER PUBLICATIONS

International Search Report and Written Opinion for International Application No. PCT/GB2013/050467 dated Aug. 23, 2014.

* cited by examiner

ROLLER TUBE

CROSS-REFERENCE TO RELATED APPLICATIONS

This application is a continuation of U.S. patent application Ser. No. 14/380,816, filed on Aug. 25, 2014, and entitled "Roller Tube", itself a United States national phase application under 35 U.S.C. §371 of International Application Serial No. PCT/GB2013/050467, filed on Feb. 25, 2013 and entitled "Roller Tube", which claims priority to Great Britain Application Serial No. 1203153.0, filed on Feb. 23, 2012, the contents of each of which being incorporated herein in their entirety.

BACKGROUND OF THE INVENTION

The present invention relates to roller tubes and in particular to roller tubes for use with roller blinds or roller shutters. The roller tubes of the present invention include within the tube a plurality of sound damping elements.

Roller tubes have been used for decades in blinds and shutters as a rotating element around which the operation of a blind or shutter may be based. Roller tubes are typically hollow cylinders and in their basic form work very well. However, as blind and shutter technology has evolved, roller tubes are increasingly being used to house therein further blind or shutter components. For example, spring arrangements to assist with the retracting of the blind or shutter, and electric motors capable of remotely retracting or deploying the blind or shutter are commonly housed within the roller tube. These further components can cause problems, especially in terms of unwanted noise.

As the skilled person appreciates, roller tubes are basically hollow cylinders. As such, noise within the cylinder may be amplified and/or transmitted along the tube as a result of its shape and the materials used in its construction: the sound waves within the tube can be amplified via constructive interference and/or resonances. Such noise is clearly undesirable.

SUMMARY OF THE INVENTION

According to a first aspect of the invention, there is provided a roller tube comprising a tube body which defines on its outwardly facing surface one or more blind substrate or shutter substrate receiving portions, and defines on its inwardly facing surface a plurality of sound damping elements, wherein the sound damping elements are located circumferentially around part or all of the inwardly facing surface of the tube body, extend longitudinally along at least part of the length of the tube body and define a plurality of sound channels within the tube.

The sound damping elements are formed as part of the roller tube body and are therefore integral with it.

The sound channels are externally closed. This means that the sound channels do not include any openings to the exterior of the roller tube in use. On the basis that the sound channels extend longitudinally along at least part of the tube, they do not include an external longitudinal opening (e.g. an axial slot) which would allow sound to escape radially from the tube. Furthermore, in use, the opposed ends of the channels are closed by respective end caps to prevent sound escaping axially from the tube.

The sound channels reduce the extent to which the sound waves can be amplified or focussed by the curved outer wall of the tube. They also reduce the extent to which the sound waves within the tube can be transmitted or cause interference with each other. Moreover, the sound channels guide the sound waves away from the source of the sound (e.g. electric motor) and allow them to diminish via energy loss, for example as a result of internal reflections along the channels.

Suitably, the or each blind substrate or shutter substrate receiving portion is an elongate receiving slot. However, the receiving portion may instead comprise any arrangement adapted to secure a blind substrate or shutter substrate to the roller tube. In an embodiment of the invention, the roller tube is a tube for a window blind. In such an embodiment, the roller tube may include a single fabric receiving slot. Alternatively, it may include two or more fabric receiving slots, such as, for example, three or four fabric receiving slots. Where the roller tube includes two or more fabric receiving slots, the slots may be the same size or they may differ in one or more dimensions.

The sound damping elements suitably extend the entire length of the roller tube and are co-terminus therewith.

In an embodiment of the invention, each sound damping element includes at least one planar portion. Suitably, the planar portion is arranged to minimise sound generated or transmitted within the roller tube from reaching a portion of the curved outer wall of the tube and/or to disrupt reflected sound waves from the curved outer wall of the tube. Thus, the planar portion may be arranged at an angle to a radial reference plane. In other words, the planar portion subtends an angle with reference to a radial plane which is greater than 0° and less than 180°.

In order to significantly reduce noise emissions from the roller tube, the damping elements suitably cover at least 50% of the internal circumference of the roller tube. The damping elements may cover more than 60%, more than 70%, more than 80% or more than 90% of the curved inwardly facing surface of the roller tube. In certain embodiments of the invention, the damping elements cover the entire inwardly facing curved surface of the roller tube. Thus, in such embodiments, the damping elements and the sound channels defined by them continuously cover the entire internal circumference of the roller tube.

In this context, the term "cover" refers to the amount of the internal circumference of the roller tube which is not visible from the central axis of the tube. Thus, where it is stated that more than 90% of the curved inwardly facing surface of the roller blind is covered by the damping elements, it means that less than 10% of the curved inwardly facing surface of the roller blind is visible from the central axis of the tube or is radially directly contactable.

The sound channels defined by the damping elements may be in the form of longitudinal cells, which may in turn be closed cells (i.e. the cells contain no openings) or open cells (i.e. the cells contain one or more openings, but not in the outer peripheral wall of the roller tube).

In an embodiment of the invention, the sound damping elements define a plurality of closed longitudinal cells located at least partially around the internal circumference of the tube body. The cells may extend around the entire internal circumference of the roller tube.

The cells suitably each comprise three or more cell walls which together define a closed cell structure. In an embodiment of the invention, each cell comprises a pair of radially inwardly projecting side walls joined at one end by the curved tube body and joined at the opposite end by a planar end wall. Thus, each cell may be essentially trapezium-shaped in cross-section, albeit with one slightly curved side.

In an embodiment comprising four-sided closed cells around the entire internal circumference of the roller tube, the circumferential cells define a central core of the roller tube, wherein the defined central core has a regular polygonal shape in cross-section. In this embodiment, each side of the polygon is defined by the planar end wall of each cell. Thus, the number of cells around the circumference of the roller tube defines the number of sides that comprise the polygon shape of the core. For example, three closed four-sided cells around the circumference of the roller tube would result in a triangular shaped core, four cells would result in a square shaped core, five cells would result in a pentagonal shaped core, six cells would result in a hexagonal shaped core, seven cells would result in a heptagonal shaped core, eight cells would result in an octagonal shaped core and so on. The central core is still able to receive therein the further blind components, such as electric motors, etc. but the further blind components would then be surrounded by sound channels in the form of closed cells, which minimise the amount of sound audible outside of the roller tube.

The skilled person will appreciate that the greater the number of cells around the circumference of the roller tube, the larger the central core can be made in terms of its cross sectional area. Thus, the number of cells around the internal circumference of the roller tube may be six or more.

The skilled person will also appreciate that the greater the number of cells, the more complex would be the tooling to fabricate the roller tube. Thus, the number of cells may suitably be twelve or less.

As an alternative to closed cells, the damping elements may define sound channels in the form of open cells. As noted above, open cells tend to include openings, such as longitudinal openings, but not through the roller tube wall.

In embodiments where the cells are open cells, the sound damping elements include a plurality of radially inwardly facing members where the members are substantially T-shaped, L-shaped, Y-shaped or V-shaped, and the sound channels include at least one internal longitudinal opening. The longitudinal opening is typically formed between adjacent or neighbouring damping elements. Thus, for example, where the damping elements are T-shaped, the cross bars of adjacent elements may be spaced apart from each other and thereby defined a longitudinal gap in the sound channel defined by the two adjacent damping elements and the portion of the roller tube located between them.

The sound damping elements may include secondary damping elements. These secondary damping elements are suitably configured to disrupt further sound waves and to absorb sound energy. These secondary damping elements may be in the form of ridges formed in one or more portions of the sound damping elements. The ridges may have a sinusoidal form, a sawtooth form or be in the form of a so-called "square wave". Thus, at one level, the portion of the sound damping element may be considered to be substantially planar and at a closer level, it carries secondary damping elements in the form of ridges. The portion of the sound damping elements which carries the secondary damping element may be an inwardly facing portion of the sound damping elements.

According to a second aspect of the invention, there is provided a roller blind or roller shutter including a roller tube as defined anywhere herein.

The term "roller blind" is intended to cover all blind systems based around a rotating tube. These include conventional roller blinds, but also include blinds such as cellular blinds and Roman blinds that operate via a rotating tube. Similarly, "roller shutters" is intended to cover all shutter systems based around rotating tubes. The skilled person will appreciate that the term "roller blind" is used herein to denote an internal blind arrangement to control the light and/or heat allowed to enter a room via an architectural opening, such as a window. In contrast, a roller shutter is either used externally on buildings, in which it may perform a security role in addition to controlling heat and/or light transmission, or is used to function as a door to control entry to or exit from a building or room.

The roller blind or roller shutter typically includes a substrate. For roller blinds, the substrate functions to control light transmission into a room. The substrate may be formed from a woven fabric substrate, a non-woven fabric substrate, a continuous polymeric substrate, a laminated substrate comprising two or more individual sheet elements, a plurality of individual horizontal slats, or a so-called "woven wood" substrate. For roller shutters, the substrate typically comprises a plurality of horizontal slats joined to each other, although polymeric sheets are also known as substrates for roller shutters.

The roller blind or roller shutter may include an electric motor which may in turn be located within the roller tube.

In an embodiment of the second aspect of the invention, the blind or shutter includes a pair of opposed mounting brackets and a vibration damping plate located between the motor and an adjacent mounting bracket, wherein the plate includes one or more portions of a vibration-absorbing material. The vibration absorbing material may be a foamed material, such as a foamed rubber, or it may be a thermoplastic elastomer. One advantage of the thermoplastic elastomer is that they can be injection moulded with the remainder of the vibration damping plate where the vibration damping plate is formed from a thermoplastic polymer.

In a further embodiment of the second aspect of the invention, the blind or shutter further includes a base plate for each mounting bracket, wherein the base plate includes one or more portions of a vibration-absorbing material. As noted above, the vibration-absorbing material may be a foamed material or it may be a thermoplastic elastomer.

Suitable sound reduction may be achieved using components that carry vibration absorbing materials. Accordingly, a third aspect of the invention provides a roller blind or roller shutter including a roller tube, an electric motor adapted for location within the roller tube, a motor mounting plate, an idle end bush and a pair of mounting brackets, wherein the mounting plate and/or the idle end bush carry on at least part thereof a vibration absorbing material.

Optionally, both the mounting plate and the idle end bush carry the vibration absorbing material. The vibration absorbing material may be located at pre-determined positions on the relevant component or it may entirely cover one or more surfaces of the relevant component.

The mounting brackets may include a portion which carries a vibration absorbing material.

In an embodiment of the invention, the vibration absorbing material is a thermoplastic elastomer which may be injection moulded.

Blind and shutter components are typically sold by the manufacturers to installers, who then take the components to build and install the blinds or shutters which are customised for the end user.

Thus, according to a fourth aspect of the invention, there is provided a kit of parts for installing a roller blind or roller shutter, the kit of parts including a roller tube as defined anywhere herein.

In an embodiment of the fourth aspect of the invention, the kit further includes an electric motor adapted to be located in use within the roller tube.

The kit of parts may further include any one or more of the following: a pair of mounting brackets; a vibration damping plate adapted to be located in use between a motor and a respective mounting bracket, wherein the damping plate includes one or more portions of a vibration-absorbing material; and idle end assembly; a blind substrate or a shutter substrate; a base plate adapted to be located between a respective mounting bracket and a base substrate (e.g. a wall or ceiling), wherein the base plate includes at least one portion of a vibration damping material.

By the term "idle end", it is meant an end of a roller blind or shutter which in use is rotatably coupled to a bracket and which is opposite to the control unit of the blind or shutter. The idle end assembly typically includes an idle end bush adapted to engage one end of the roller tube and forms a bearing/axle arrangement with an idle end bracket which is adapted to allow the idle end of the roller tube to rotate relative to the idle end bracket. Examples of suitable idle end assemblies are defined and described in WO2010/139945, the contents of which are incorporated herein in their entirety by reference.

The skilled person will appreciate that the features described and defined in connection with the aspect of the invention and the embodiments thereof may be combined in any combination, regardless of whether the specific combination is expressly mentioned herein. Thus, all such combinations are considered to be made available to the skilled person.

BRIEF DESCRIPTION OF THE DRAWINGS

An embodiment of the invention will now be described, by way of example only, with reference to the accompanying drawings in which.

DETAILED DESCRIPTION OF THE PREFERRED EMBODIMENTS

For the avoidance of doubt, the skilled person will appreciate that in this specification, the terms "up", "down", "front", "rear", "upper", "lower", "width", etc. refer to the orientation of the components as found in the example when installed for normal use as shown in the Figures.

Figure 1:
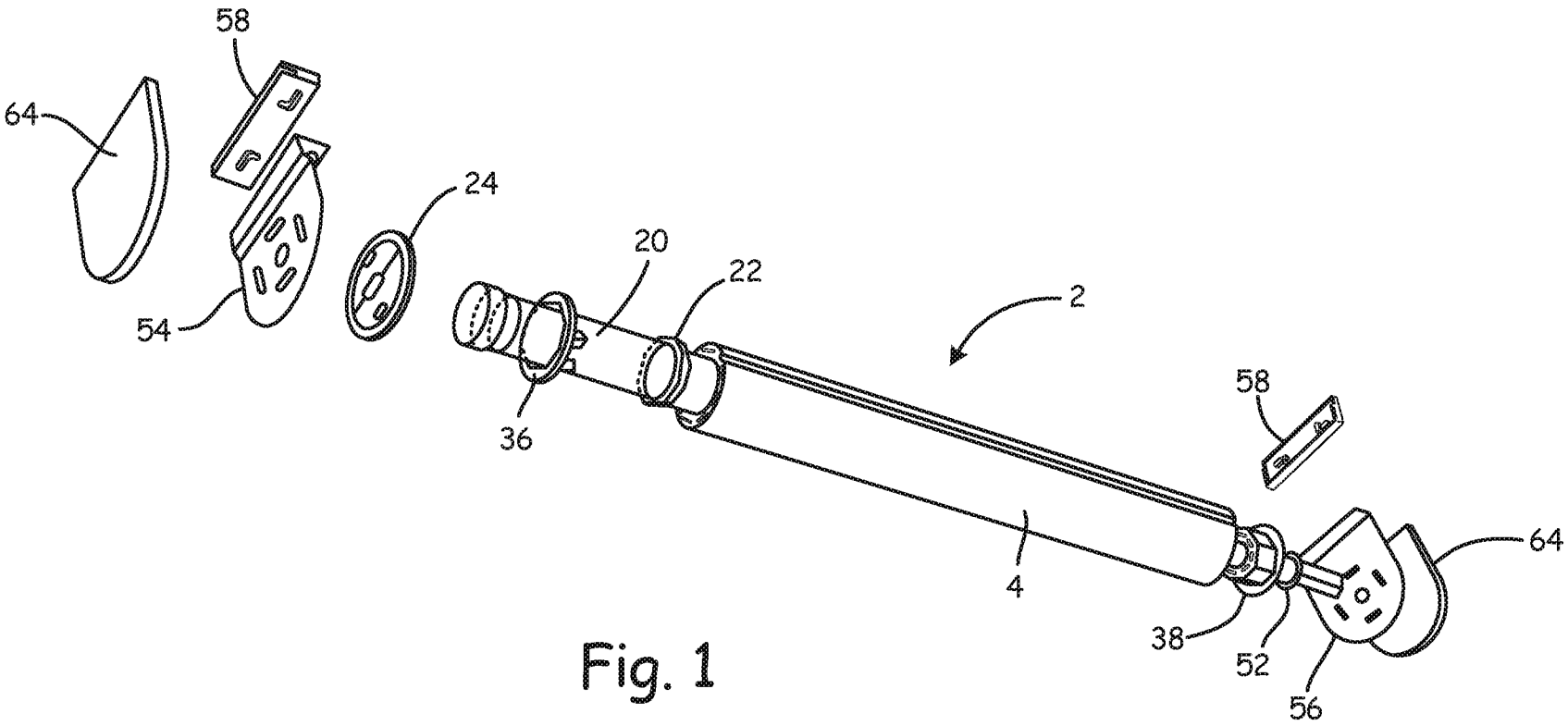
FIG. 1 is an exploded perspective view of a roller blind according to the invention.

A roller blind assembly 2 is shown in FIG. 1. The assembly 2 comprises a roller tube 4 which is shown in more detail in FIG. 2. The roller tube 4 includes an outer tube wall 6 within which is defined a pair of opposed fabric receiving slots 8. In this embodiment, the two slots 8 are substantially identical. However, it will be appreciated that slots 8 having different dimensions may be incorporated.

Projecting radially inwards from the outer tube wall 6 are eight side wall elements 10 which are equally circumferentially spaced from each other. Each pair of adjacent side wall elements 10 are joined at their inwardly facing end by an end wall 12. The arrangement of end walls 12 provides the roller tube 4 with an octagonally shaped core surrounded by six large closed cells 16 and four small closed cells 18, where each of the large closed cells 16 is defined by a pair of radial side wall elements 10, an end wall 12 and a portion of the outer tube wall 6, and each of the small closed cells 18 is defined by a side wall element 10, part of a fabric receiving slot 8, part of an end wall 12 and a portion of the outer tube wall 6.

Located within the roller tube 4 is an electric motor 20 (Sonesse™ from Somfy Systems Inc., NJ, USA). The motor 20 includes an octagonal drive bush 22 which is sized and configured to engage the end walls 12 of the roller tube 4.

Figure 3:
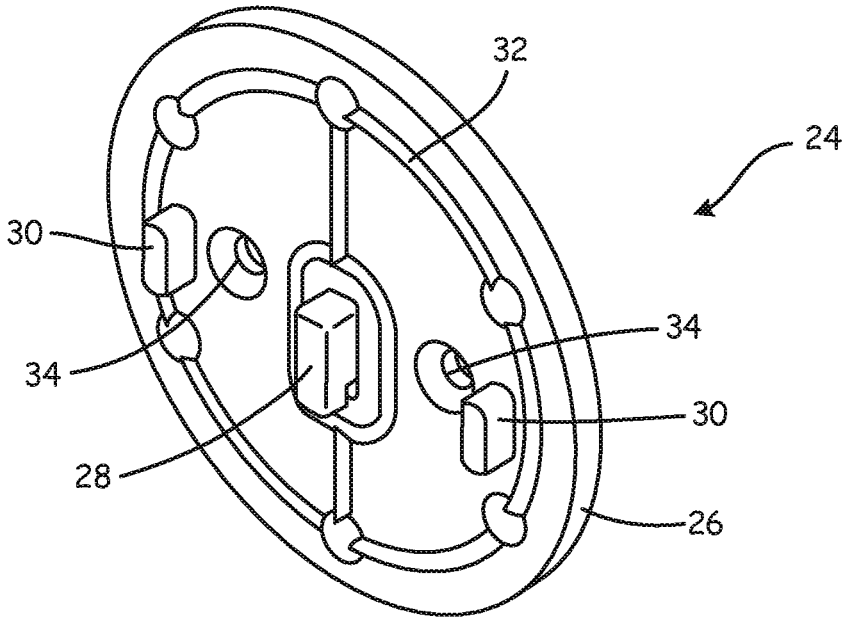
FIG. 3 is a perspective view of the vibration damping plate shown in FIG. 1.

To the motor 20 is connected a mounting plate 24 which is shown in more detail in FIG. 3. The mounting plate 24 is largely moulded from a rigid thermoplastic material to define a plate body 26. On its outwardly facing face (i.e. the face shown in FIG. 3 and which in use contacts a mounting bracket) is provided a central locating lug 28 and a pair of outer locating lugs 30. The outer face also includes portions 32 of a thermoplastic elastomer which extend beyond the face and which form a contact surface.

A pair of securing holes 34 are provided through the mounting plate which correspond to threaded bores provided in an end face of the motor 20 such that the mounting plate 24 may be secured to the motor 20 via a pair of screws (not shown).

Figure 4A:
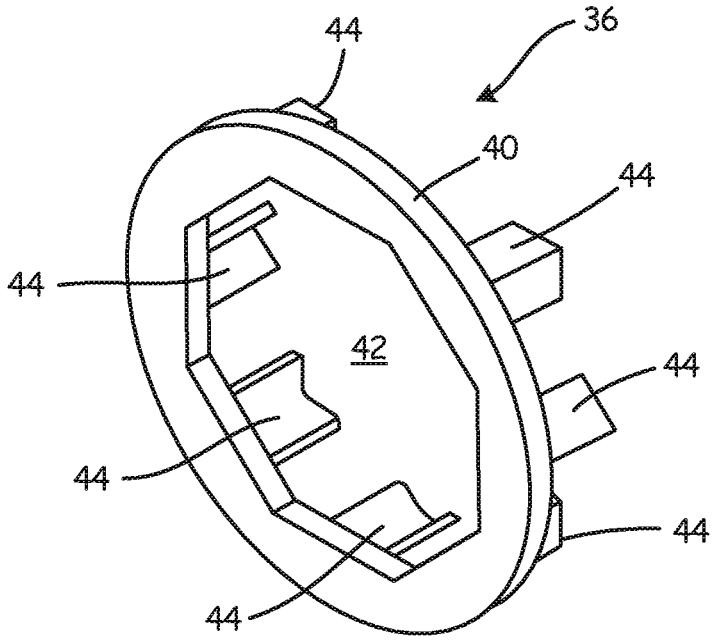
FIG. 4A is a perspective view of a first end cap shown in FIG. 1.
Figure 4B:
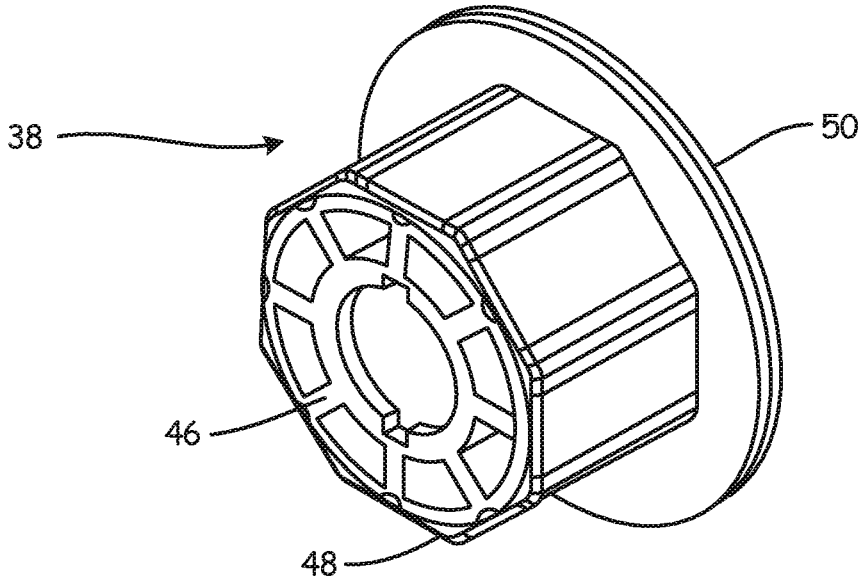
FIG. 4B is a perspective view of a second end cap shown in FIG. 1.

In order to close at each end the longitudinal cells 16, 18 of the roller tube 4, a pair of end caps 36, 38 are provided and these are shown in more detail in FIG. 4. The end cap 36 is adapted to close the cells 16, 18 at the control end of the roller tube 4 (i.e. the end that contains the motor 20) and comprises a substantially annular shaped body 40 which defines an octagonal-shaped inner core 42 corresponding to the core 14 of the roller tube 4 and a circular outer periphery corresponding to the outer tube wall 6. With this arrangement, the end cap 36 is adapted to close all of the cells 16, 18 defined by the roller tube 4 without interfering with motor 20 or its drive bush 22. In order to secure the end cap 36 to the roller tube 4, the end cap 36 further includes a number of securing legs 44 which provide a friction fit within the cells 16.

Turning now to the end cap 38, this is adapted to close the cells 16,18 at the idle end of the roller tube 4. The end cap comprises a rigid body 46 which carries a thermoplastic elastomeric coating 48 having an octagonal cross-sectional shape sized to form a friction fit within the roller tube 4. At one end of the cap 38 is a flange 50 having a diameter equal to that of the outer tube wall 6. The flange is also covered with a thermoplastic elastomeric coating.

Projecting axially from the end of the cap 38 is a conventional idle end bearing assembly 52 such as the one described in WO2010/139945.

At either end of the roller tube 4 is located a respective mounting bracket 54, 56, which are known parts (available from Louver-Lite Limited) and which comprise apertures adapted to receive the locating lugs 28, 30 of the motor mounting plate 24 at one end and a cruciform engagement portion of an end pin forming part of the idle end assembly at the other end.

Figure 5:
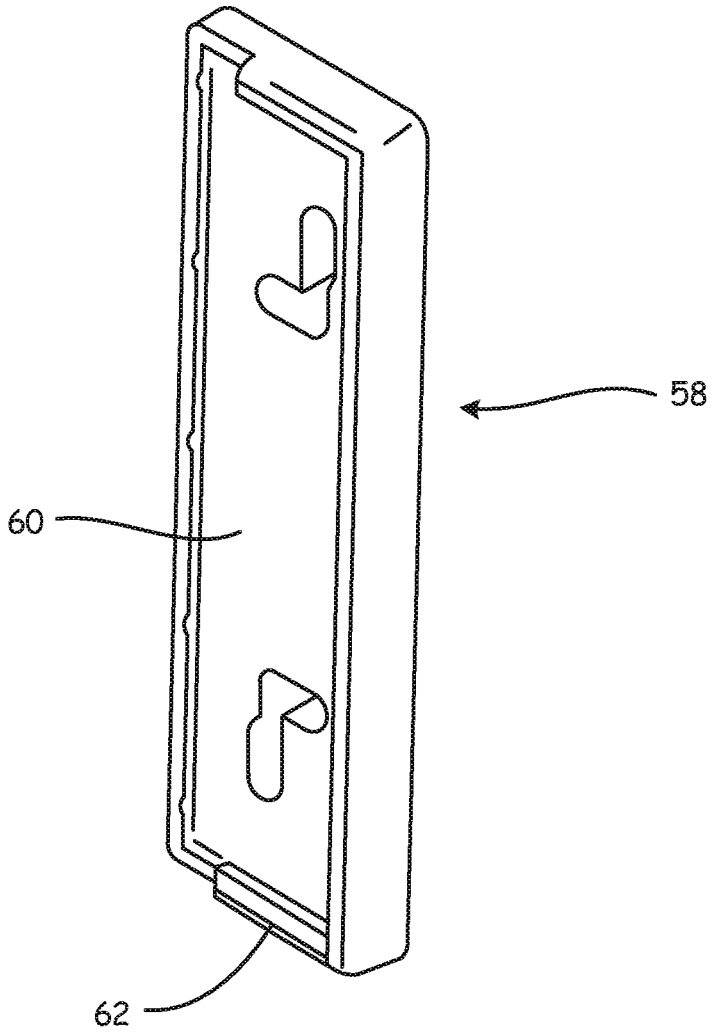
FIG. 5 is a perspective view of the base plate shown in FIG. 1.

The mounting brackets 54, 56 are typically secured to a supporting substrate (e.g. a wall) via respective base plates 58, which are shown in more detail in FIG. 5. The base plates 58 each comprise a rigid metal body 60 which is covered with a thermoplastic elastomer to reduce transmission of vibrations and sound energy. The elastomeric coating defines a peripheral ridge 62 around the front face of the base plate 58. The base plate 58 includes a pair of shaped apertures adapted to receive therethrough fixing elements (not shown), such as screws.

A pair of cover elements 64 push fit onto the respective mounting brackets 54, 56 to provide an aesthetically pleasing finish.

To assemble the blind assembly 2, a sheet of blind fabric (not shown) having the desired length is first secured to the roller tube 4 via one of the fabric receiving slots 8. The electric motor 20 is then inserted into one end of the roller tube and retained in place via the drive bush 22 and the end cap 36. The motor mounting plate 24 is secured to the end face of the motor 20 via a pair of screws (not shown) passing through the apertures 34 in the mounting plate 24. At the other end, the cells 16, 18 are closed by the idle end cap 38.

The two mounting brackets 54, 56 are secured to a suitable support substrate, such as a wall, via respective base plates 58. The mounting plate 24 is then coupled to its respective mounting bracket 54 such that the locating lugs 28, 30 are located within the respective apertures in the mounting plate 54 and the support pin of the idle end assembly 52 is located in its mounting bracket 56. Finally, the two cover elements 64 are press-fitted to their respective mounting brackets 54, 56 and the motor is connected to its power supply and control assembly.

In use, noise and vibration generated by the motor is suppressed by the cells 16, 18 and by the octagonal shape of the core 14, which together help to reduce amplification of the sound waves. In addition, the thermoplastic elastomeric portions 32 on the motor mounting plate 24 and the similar coatings on the end cap 38 and base plates 58 help reduce transmission of the vibrations and associated noise from the roller tube 4.

Figure 2:
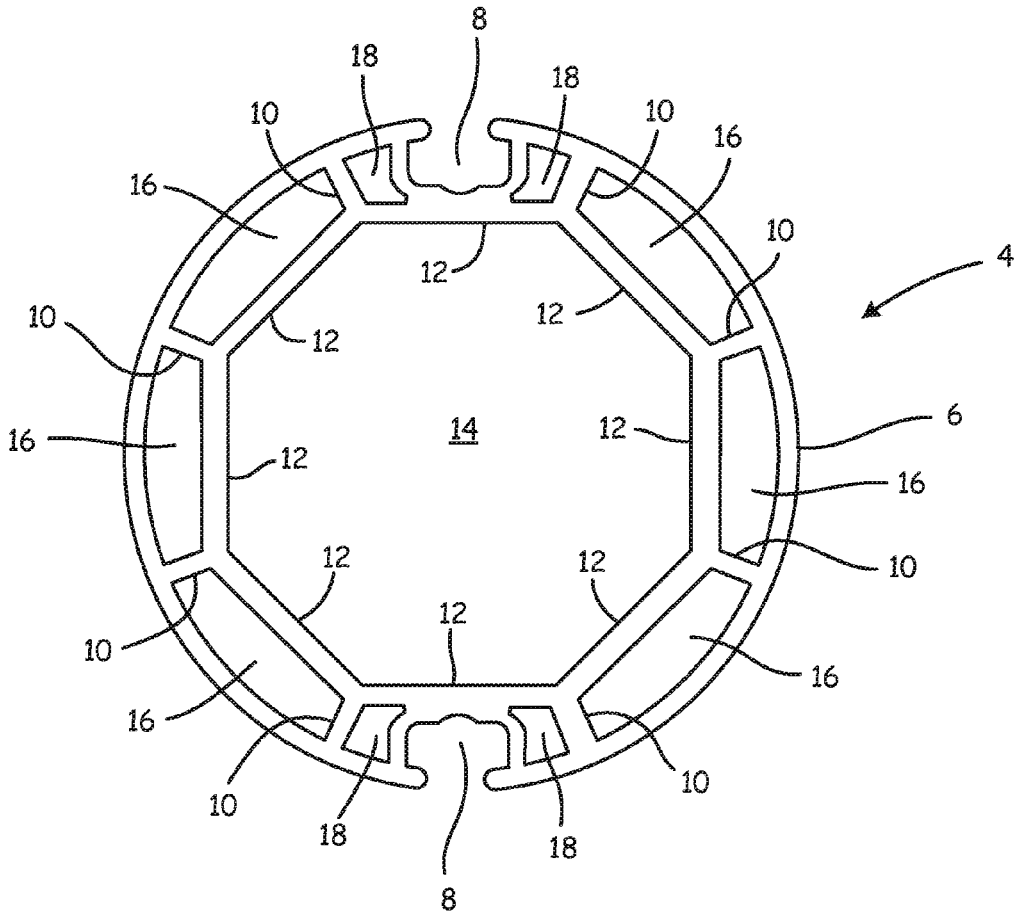
FIG. 2 is a cross-sectional view through the roller tube shown in FIG. 1.

Although one specific arrangement of the sound damping elements is shown in FIG. 2, other arrangements are possible and some examples of alternative arrangements of sound damping elements are shown in FIGS. 6*a* to 6*e*.

Figure 6A:
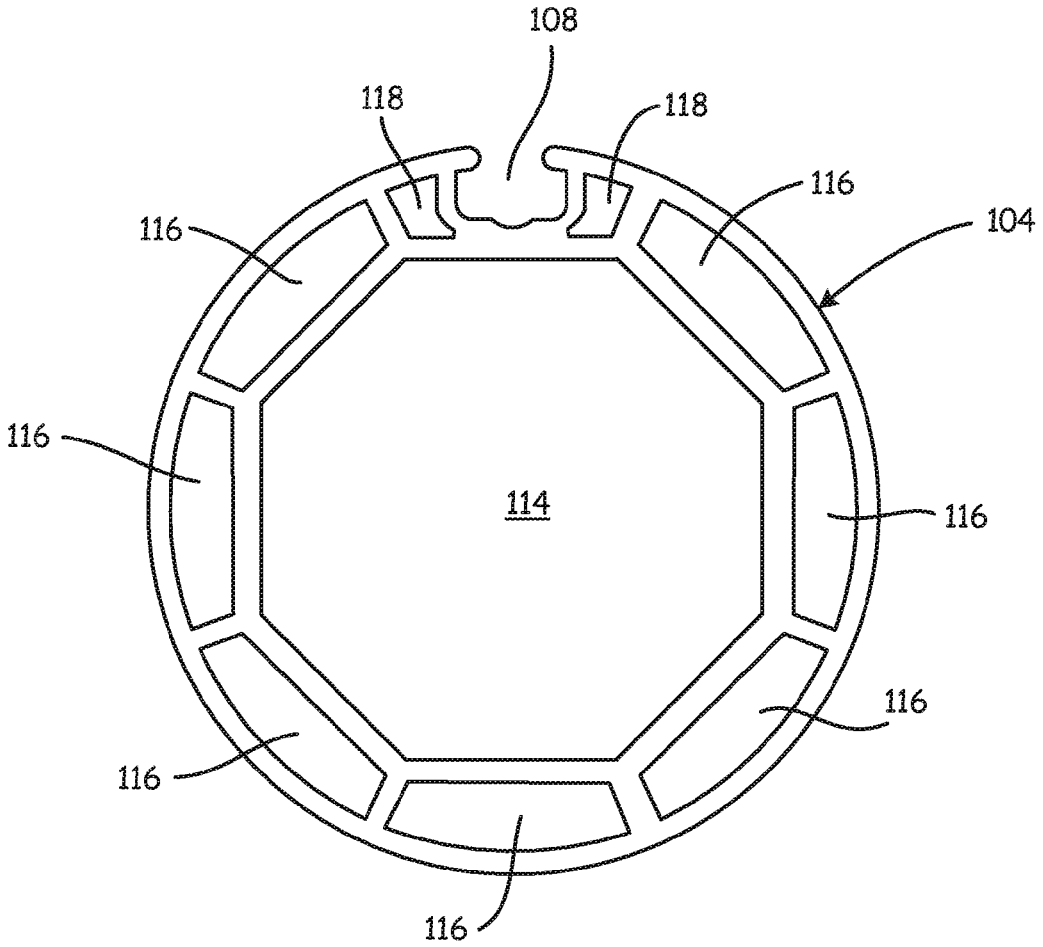
FIGS. 6A to 6E show different options for the damping elements in the roller tube.

The arrangement shown in FIG. 6*a* is similar to that shown in FIG. 2, except that in FIG. 6*a*, the roller tube 104 only includes a single fabric receiving slot 108. This results in seven large cells 116 and only two small cells 118 surrounding the core 114.

Figure 6B:
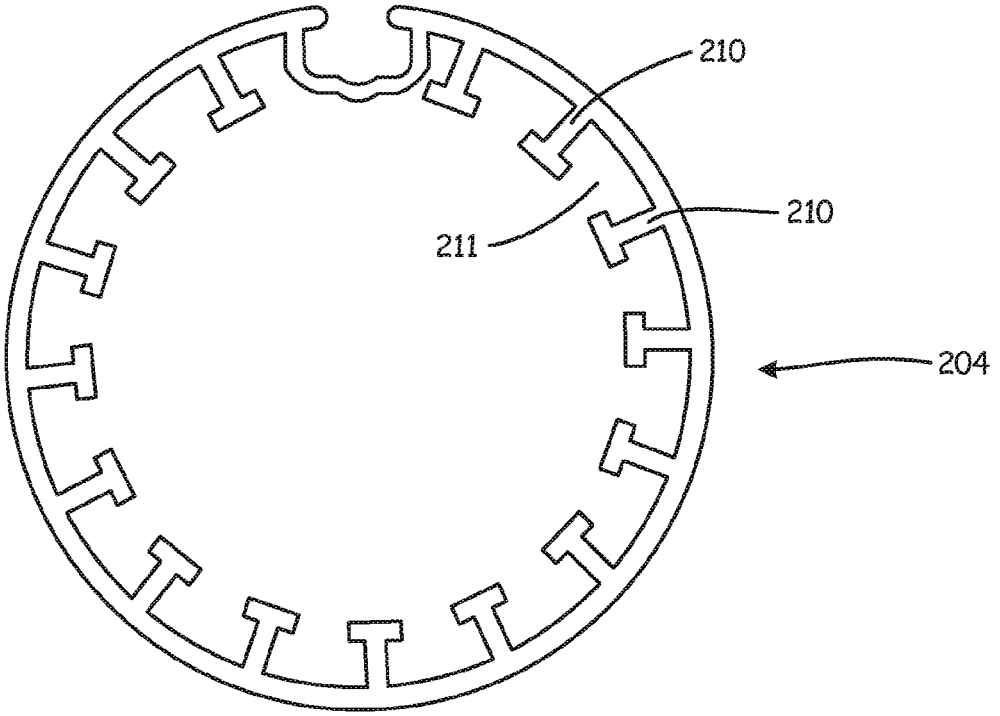

FIG. 6*b* shows an arrangement of T-shaped sound damping elements 210 which define a number of sound channels having an open cell configuration, as there are gaps 211 between the crossbars of adjacent elements 210.

Figure 6C:
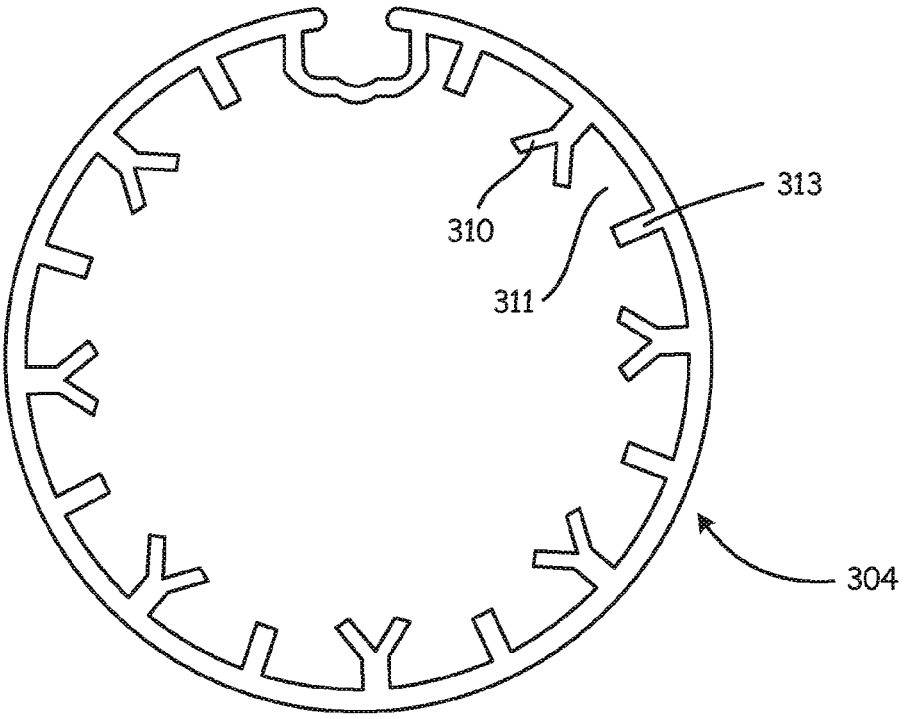

FIG. 6*c* shows an alternating arrangement of Y-shaped damping elements 310 and ribs 313 having a rectangular cross section. Again, as there are gaps 311 between the damping elements 310 and the ribs 313, the sound channels have an open cell configuration.

Figure 6D:
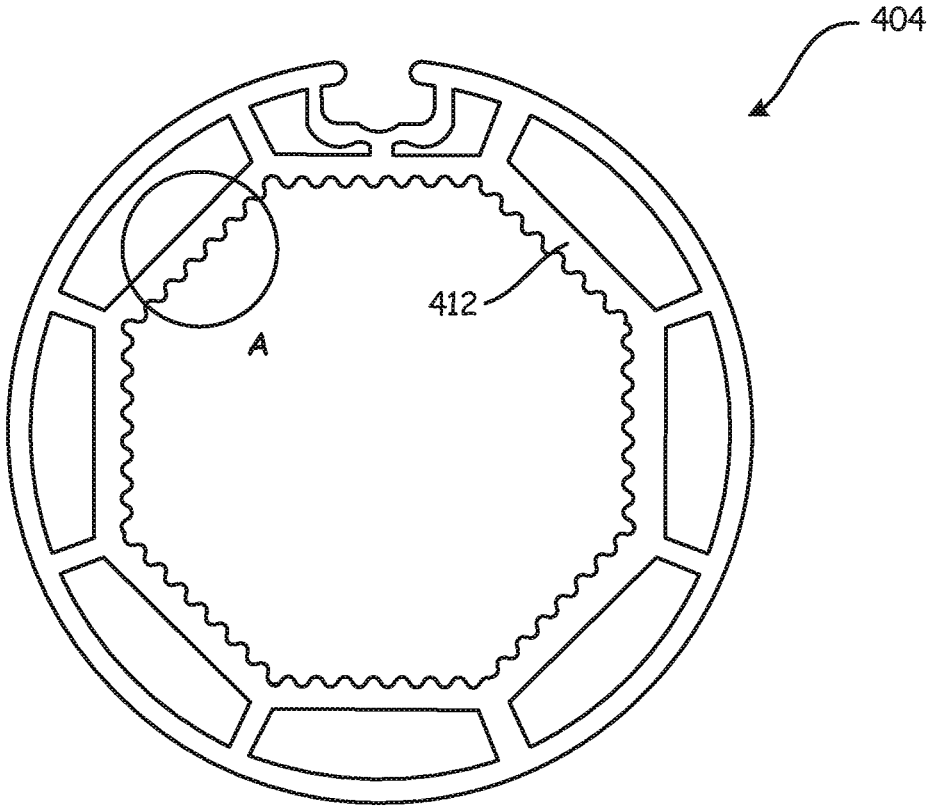
Figure 6D:
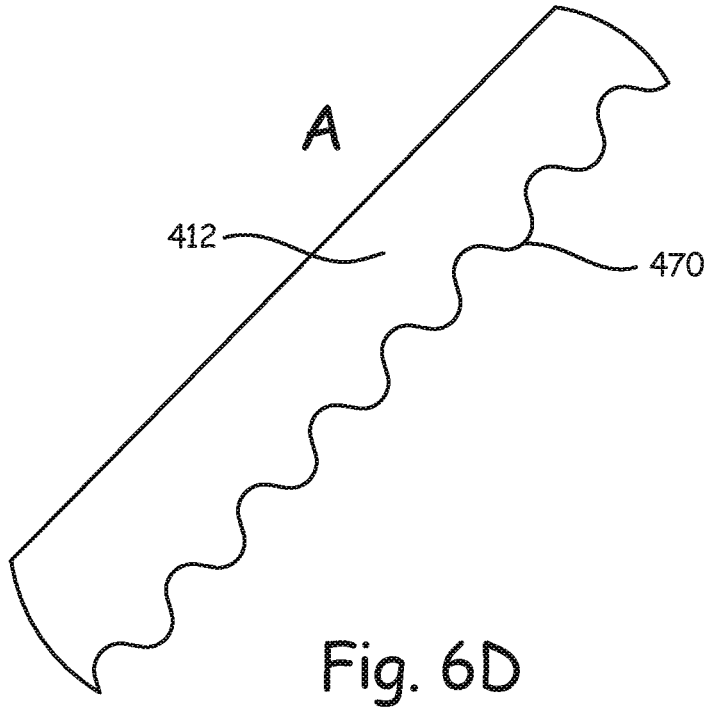

FIG. 6*d* shows a roller tube 404 which is similar to the tube 104 shown in FIG. 6*a*, except that in this embodiment, the end walls 412 of the tube 404 include secondary damping elements in the form of ridges 470 having a sinusoidal profile as shown more clearly in the enlarged section A.

Figure 6E:
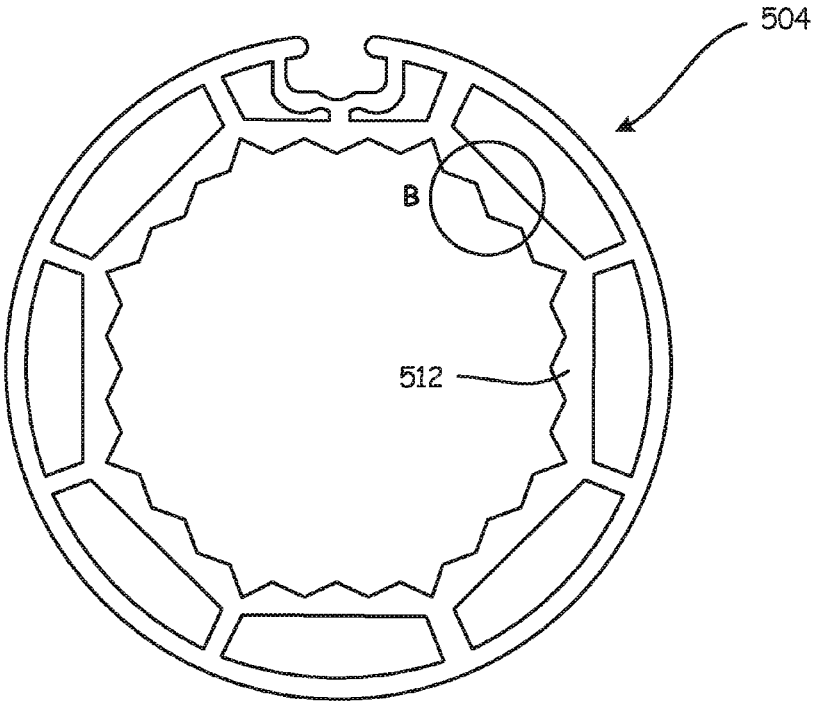
Figure 6E:
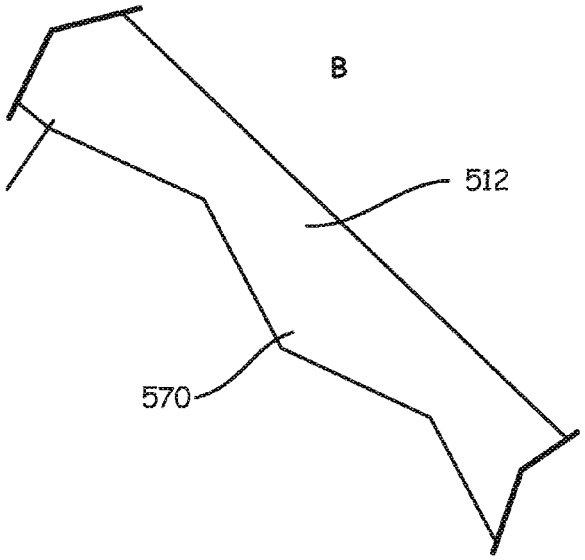

FIG. 6*e* shows a roller tube 504 which is similar to the tube 404 shown in FIG. 6*d*, but in this embodiment, the secondary damping elements 570 are in the form of ridges having a shallow sawtooth profile, as shown more clearly in the enlarged section B.

The invention claimed is:

1. A roller blind or a roller shutter including: (i) a roller tube comprising a tube body which defines on its outwardly facing surface one or more blind substrate or shutter substrate receiving portions, and defines on its inwardly facing surface a plurality of sound damping elements, wherein the sound damping elements are located circumferentially around part or all of the inwardly facing surface of the tube body, extend longitudinally along at least part of the length of the tube body and define a plurality of sound channels within the tube and wherein the sound damping elements define a plurality of closed longitudinal cells located at least partially around the internal circumference of the tube body, each closed longitudinal cell comprising a pair of radially inwardly projecting side walls joined at one end by the tube body and joined at the opposite end by a planar end wall; (ii) an electric motor separately receivable within the roller tube; (iii) a pair of opposed mounting brackets; (iv) a base element for each of said mounting brackets; (v) an idle end bush; and (vi) a vibration damping plate located between the motor and an adjacent one of said mounting brackets, wherein vibration-absorbing material is carried on and extends from at least one of the vibration damping plate, idle end bush, mounting brackets, and base elements.

2. The roller blind or a roller shutter according to claim 1, wherein the closed longitudinal cells are located around the entire circumference of the tube body.

3. The roller blind or a roller shutter according to claim 2, wherein the circumferential cells define a central core of the tube, wherein the core has a regular polygonal shape in cross section and wherein the polygon has three or more sides.

4. The roller blind or a roller shutter according to claim 3, wherein the core has a regular polygonal shape in cross section and the polygon has 3 to 12 sides.

5. The roller blind or a roller shutter according to claim 1, wherein one or more portions of the sound damping elements include secondary damping elements.

6. The roller blind or roller shutter according to claim 1, wherein the vibration absorbing material is a thermoplastic elastomer.

7. The roller blind or roller shutter according to claim 6 wherein the vibration absorbing material is carried on and extends from each of the vibration damping plate, idle end bush, mounting brackets, and base elements.

8. The roller blind or roller shutter according to claim 6 wherein the vibration absorbing material is co-molded with at least one of the vibration damping plate, idle end bush, mounting brackets, and base elements.

* * * * *